US006163277A

United States Patent [19]

Gehlot

[11] Patent Number: 6,163,277

[45] Date of Patent: Dec. 19, 2000

[54] SYSTEM AND METHOD FOR SPEED LIMIT ENFORCEMENT

[75] Inventor: Narayan L. Gehlot, Sayerville, N.J.

[73] Assignee: Lucent Technologies Inc., Murray Hill, N.J.

[21] Appl. No.: 09/177,839

[22] Filed: Oct. 22, 1998

[51] Int. Cl.[7] ..... G08G 1/09

[52] U.S. Cl. ..... 340/905; 340/902; 340/936; 340/539; 701/117

[58] Field of Search ..... 340/902, 905, 340/904, 933, 936, 539, 825.06; 701/117

[56] References Cited

U.S. PATENT DOCUMENTS

| | | | |
|---|---|---|---|
| 4,591,823 | 5/1986 | Horvat | 340/905 X |
| 5,465,079 | 11/1995 | Bouchard et al. | 340/576 |
| 5,546,311 | 8/1996 | Sekine | 340/902 X |
| 5,570,087 | 10/1996 | Lemelson | 340/870.05 |
| 5,574,641 | 11/1996 | Kawakami et al. | 340/575 X |
| 5,694,116 | 12/1997 | Kojima | 340/576 |
| 5,717,606 | 2/1998 | Hara et al. | 340/439 X |
| 5,745,031 | 4/1998 | Yamamoto | 340/439 |
| 5,815,070 | 9/1998 | Yoshikawa | 340/439 |
| 5,821,860 | 10/1998 | Yokoyama et al. | 340/576 |
| 5,847,661 | 12/1998 | Ricci | 340/902 |
| 5,874,892 | 2/1999 | Antonellis et al. | 340/438 |
| 5,878,156 | 3/1999 | Okumura | 382/117 |

*Primary Examiner*—Daryl Pope
*Attorney, Agent, or Firm*—Stroock & Stroock & Lavan LLP

[57] ABSTRACT

A system for enforcing highway speed limits comprising an antenna and one or more sensors positioned on a vehicle, the antenna capable of receiving data indicative of a speed limit for a roadway, the one or more sensors capable of gathering data indicative of a driving pattern of the vehicle, and a processing unit in communication with the antenna and the one or more sensors, the processing unit receiving the speed limit data from the antenna and the driving pattern data from the sensors, analyzing the speed limit data and the driving pattern data to asses whether a predetermined action should be initiated and initiating a predetermined action in response to the assessment.

20 Claims, 3 Drawing Sheets

SYSTEM AND METHOD FOR SPEED LIMIT ENFORCEMENT

FIELD OF THE INVENTION

This invention relates to a system and method for enforcing speed limits, and, in particular, to a system and method for enforcing speed limits on highways by utilizing wireless communications and digital signal processing technology.

BACKGROUND OF THE INVENTION

The present invention is directed at improving highway safety by enabling a more efficient use of law enforcement resources, and more accurate and equitable distribution of vehicle insurance costs. The present invention relates to a system and method for enforcing speed limits on highways by utilizing wireless communications and digital signal processing technology.

Nearly every highway in the world has a posted speed limit. However, anyone who drives a car knows that the posted speed limits are ignored by a large number of drivers. These speeding drivers often drive recklessly at a speed well over the posted speed limit. These speeding drivers are the cause of countless accidents each year, resulting in a substantial number of injuries and fatalities. The only system in place today to catch or stop such speeding drivers is the presence of police officers, whether on the highway in their cars, overhead in helicopters or in some countries, the use of fixed cameras or the like. The police often use doppler radar or laser guns to check the speed of cars. However, the number of speeding drivers far outnumber the number of law enforcement officials dedicated to enforcing the posted speed limits. Furthermore, the speeders are often equipped with laser or doppler radar detectors, and are thus often able to evade police detection.

The prior art systems for enforcing speed limits have a number of deficiencies. First, the prior art systems are expensive and an inefficient use of limited law enforcement resources. The police spend much of their time hiding from speeding motorists in an effort to catch them. Also, if the police do detect a speeding car they may need to engage in a high speed chase in order to catch the speeder, which can result in a more dangerous atmosphere for other innocent drivers. The police may also catch innocent drivers, who merely speed up for a limited short time in order to pass a slower moving vehicle. The prior art systems have no means to provide a speeding driver with any real-time feedback of the consequences of his speeding.

The prior art system of reliance on police presence is inadequate to meet the demands of enforcing the speed limit. The present invention is directed at overcoming the shortcomings of the prior art and is directed at a system and method for enforcing speed limits.

SUMMARY OF THE INVENTION

The present invention relates to system and method for enforcing speed limits, and, in particular, to a system and method for enforcing speed limits on highways by utilizing wireless communications and digital signal processing technology.

The system generally includes an antenna mounted or otherwise installed on a vehicle. The antenna is capable of both receiving and outputting data to a source external to the vehicle. The antenna also communicates with a processing unit mounted or otherwise installed on the vehicle. The processing unit also communicates with sensors or other instrumentation or equipment within the vehicle.

In a preferred embodiment, while the vehicle is traveling on a highway, the antenna receives speed limit data from an external source. The speed limit data may comprise, by way of a non-limiting example, the highway road identification number, the state the vehicle is traveling in, the speed limit for that stretch of road, whether that stretch of road is in a construction zone, etc. In a preferred embodiment the speed limit data comprises the speed limit of the current stretch of roadway. In alternative embodiments, the speed limit may be derived from other received data or the system may derive the speed limit from an onboard database exclusively or in combination with received data. In any event, the speed limit data is communicated to or otherwise accessible to the processing unit. The processing unit also receives driving pattern data from the onboard sensors. The driving pattern data may comprise, by way of a non-limiting example, the speed the vehicle is currently traveling at, and the elapsed time the auto has been at that speed and other speeds. At a minimum, the driving pattern data should comprise the current speed of the vehicle. The processing unit compares the speed limit data with the driving pattern data, analyzes the two sets of data, and determines whether a predetermined action should be initiated. The predetermined actions may range in severity from, for example, initiating an audio or visual warning, to automatically slowing the vehicle down to the posted speed limit and/or notifying the police or the driver's insurance company that the vehicle is speeding. As used herein, the term vehicle is meant to have a broad meaning and meant to encompass any type of vehicle such as, by way of a non-limiting example, automobiles, trucks, trains, boats, motorcycles, etc.

The present invention also provides a system whereby the police can establish direct communication with a speeding vehicle and the driver therein. For example, if the police detect a speeding vehicle, the police can use the system of the present invention to access the other auto's processing unit to retrieve the driving pattern data as well as data on the vehicle itself, the driver, the driver's long term driving history, the driver's short term driving pattern, or any other information stored or otherwise accessible in the other auto's processing unit. The system provides for a direct communication between the police and the speeding driver which will enable the police to have more flexibility and options in attempting to stop the speeding vehicle, including for example, a direct communication with the other auto's processing unit to control the speed or other functions of the vehicle in appropriate circumstances.

It is envisioned that the system and method of the present system would be desirable to many different entities or individuals, such as, for example, shippers, couriers, police agencies, insurance companies and parents, to name a few. For example, an insurance company faced with insuring a driver who has previously been found speeding, may require a system designed in accordance with the instant invention be installed in that drivers vehicle. Also, an insurance company and/or state and federal agencies may offer incentives such as discounts to those who voluntarily install the system of the present invention.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

DESCRIPTION OF THE DRAWING FIGURES

In the drawing figures, which are not to scale, and which are merely illustrative, and wherein like reference numerals depict like elements throughout the several views.

DETAILED DESCRIPTION OF THE PREFERRED EMBODIMENTS

The present invention relates to a system and method for enforcing speed limits, and, in particular, to a system and method for enforcing speed limits on roadways by utilizing wireless communications and digital signal processing technology. As used herein, the term roadway is intended to include any passable road, street, highway or other path over which a moving vehicle may travel.

Figure 1:
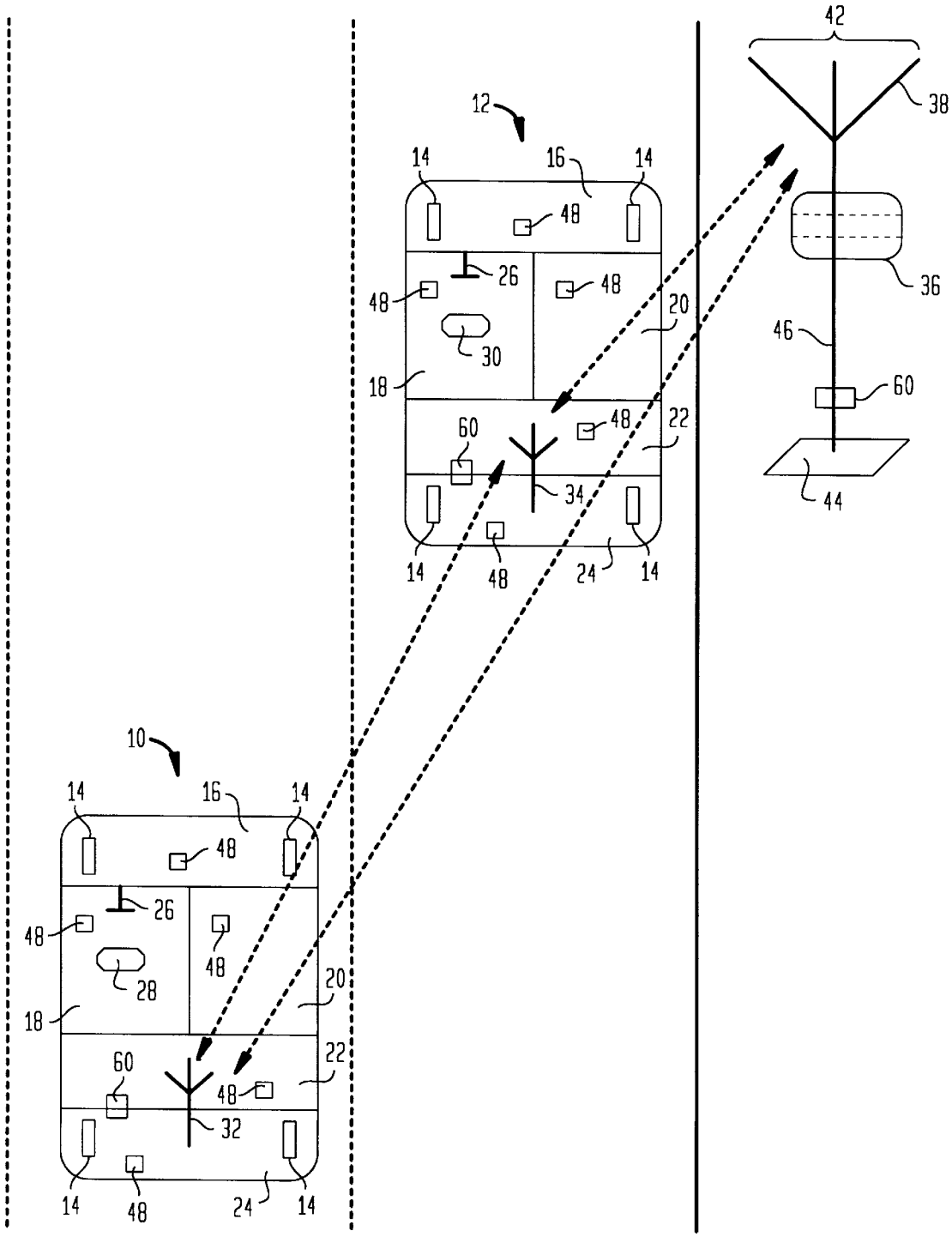
FIG. 1 is a top view of a civilian vehicle, police vehicle, and external source in accordance with the present invention.

In a preferred embodiment, as seen in FIG. 1, the system generally includes a police vehicle, generally indicated as 10, which is capable of sending data to, and receiving data from, a civilian vehicle, generally indicated as 12, and vice versa. Vehicles 10 and 12 generally include front and rear wheels 14, an engine compartment 16, a driver section 18, a passenger section 20, a rear seat section 22 and a trunk section 24. Driver section 18, passenger section 20 and rear seat section 22 comprise a passenger cabin 62. Engine compartment 16, driver section 18, passenger section 20, rear seat section 22 and trunk section 24 are defined for purposes of the present invention as sections within vehicle 10 and 12. Police vehicle 10 has a driver or policeman 28 positioned behind steering column 26, and civilian vehicle 12 has a driver 30 positioned behind steering column 26. The features described herein as associated with police vehicle 10 may also be deployed at distributed locations along a roadway, and/or deployed in part along a roadway and in part in a police vehicle, as a matter of design choice.

Police vehicle 10 and/or civilian vehicle 12 also have a number of sensors 48 installed or otherwise mounted on the respective vehicles to detect conditions both within the vehicle and conditions outside the vehicle. That is, sensors 48 are designed, constructed and positioned so as to detect one or more conditions within any one or more of engine compartment 16, driver section 18, passenger section 20, rear seat section 22 and trunk section 24. The sensors are also designed, constructed and positioned so as to detect one or more conditions outside of engine compartment 16, driver section 18, passenger section 20, rear seat section 22 and trunk section 24, i.e., outside the vehicle.

By way of a non-limiting example, the type of sensors utilized can be selected from any number of commercially available sensors such as motion sensors, infrared sensors, position sensors, audio sensors, video sensors, chemical sensors, sound sensors, touch sensors or radio frequency sensors, or any combination thereof. One of skill in the art will recognize that a specially designed sensor may also be utilized without departing from the spirit of the invention. One of skill in the art will also recognize that the number, type, position and function of the specific sensors indicated is in no way limiting to the present invention, and that any number of additions, subtractions, substitutions or modifications could be made without departing from the spirit of the invention.

Sensors 48 are designed, constructed and positioned so as to sense and gather driving pattern data, including, by way of a non-limiting example, the current speed of vehicle 12 and the elapsed time at that speed, as well as past speeds and elapsed times at those speeds. Sensors 48 are designed, constructed and positioned so as to communicate with a processing unit 60. That is, sensors 48 on police vehicle 10 communicate with processing unit 60 on police vehicle 10, and sensors 48 on civilian vehicle 12 communicate with processing unit 60 on civilian vehicle 12. One of skill in the art will recognize that the sensors 48 and processing unit 60 on police vehicle 10 are not essential to the operation of the present invention. Processing units 60 may be located anywhere within vehicle 10 or 12. The sensors 48 sense and/or gather data to be communicated with their respective processing units 60. Processing unit 60 may be a Digital Signal Processor or any other comparable type unit for receiving and analyzing data, and controlling controllable devices to initiate pre-programmed responses as a result of analyzing data, such as, for example a programmable microprocessor, micro computer, mini-computer PLC controller, or the like. In a preferred embodiment processing units 60 utilizes parallel processing or neural network/fuzzy logic. Processing units 60 are also capable of receiving data and/or instructions from sources other than sensors 48, i.e., an external source 42, as well as from other external sources such as remote control devices, cellular telephone signals, paging signals, radio or infrared signals, or externally positioned push buttons or keypads (not shown).

As seen in FIG. 1, external source 42 may be a road sign or any other structure along the side of the road or proximate the road, and may comprise, by way of non-limiting example, a base 44 for holding a pole 46 which supports a sign board 36 and antenna 38. External source 42 is capable of sending speed limit data to vehicles 10 and 12 either directly to the sensors 48 or directly to the processing units 60, and external source 42 is capable of and receiving data to and from both police vehicle 10 and civilian vehicle 12, either directly from sensors 48 or directly from the processing units 60. One of skill in the art will recognize that external source 42 may also have its own processing unit 60. External source 42 may be any device capable of performing the functions described herein without departing from the spirit of the invention, such as, for example, a satellite system such as a global positioning system, or a data base with infrared sensors or bar codes on the sign post 36.

Figure 2:
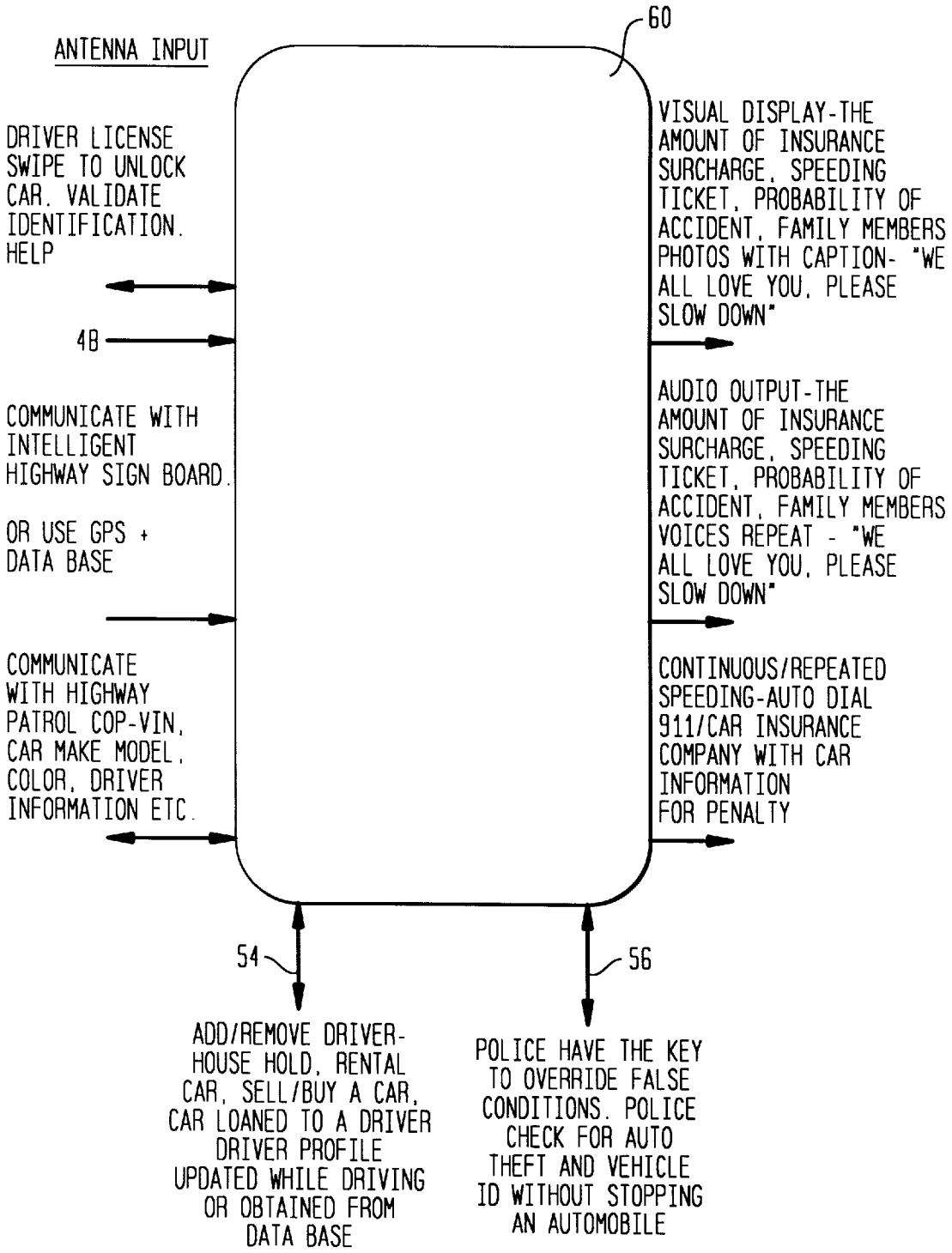
FIG. 2 is a block diagram of the digital signal processor of the present invention.

As seen in FIG. 2, driving pattern data is gathered from the different sensors 48 and communicated to processing unit 60. Processing unit 60 has a number of predetermined or stored responses or actions. As described more fully below, processing unit 60 analyzes the driving pattern data and the speed limit data and determines whether a response is necessary, and if so, which specific response or action. Such actions may include, by way or a non-limiting example, nothing, an audio signal, a visual signal, reducing the speed of the vehicle, automatically dialing the police or another party, generating a traffic ticket, disabling the vehicle, or any combination thereof. One of skill in the art will recognize that additions, subtractions, substitutions or modifications to the stored predetermined actions may be provided without departing from the spirit of the invention.

As seen in FIG. 2, processing unit 60 may also comprise portals or input ports 54 and 56, which are capable of receiving data and/or instructions from sources other than the onboard sensors via metallic or optical signal conductors. For example, the following type of information may be stored, added, subtracted or modified in processing unit 60: information about the vehicle, i.e., vehicle identification number, the owner of the vehicle, authorized drivers, rental car information, authorized driver profiles including driving histories, history about the vehicle, etc. Other data and/or instructions may also be stored, added, subtracted or modified in processing unit 60, such as: the police may be capable of overriding the predetermined actions and/or providing other non-predetermined actions. One of skill in the art will recognize that any number of additional portals or input ports could be provided to processing unit 60 without departing from the spirit of the invention. Further, while the term antenna, portals and/or input ports have been described above, any type of communication with processing unit 60 is envisioned without the need for a particular or specific type of antenna or other type of receiving device or physical connection. That is, processing unit 60 is also capable of receiving data and/or instructions from sources other than the sensors such as remote control devices, cellular telephone signals, paging signals, radio or infrared signals, or externally positioned push buttons or keypads (not shown). Thus, the term antenna is used broadly to mean any type of device or means for receiving any type of data carrying signal.

Figure 3:
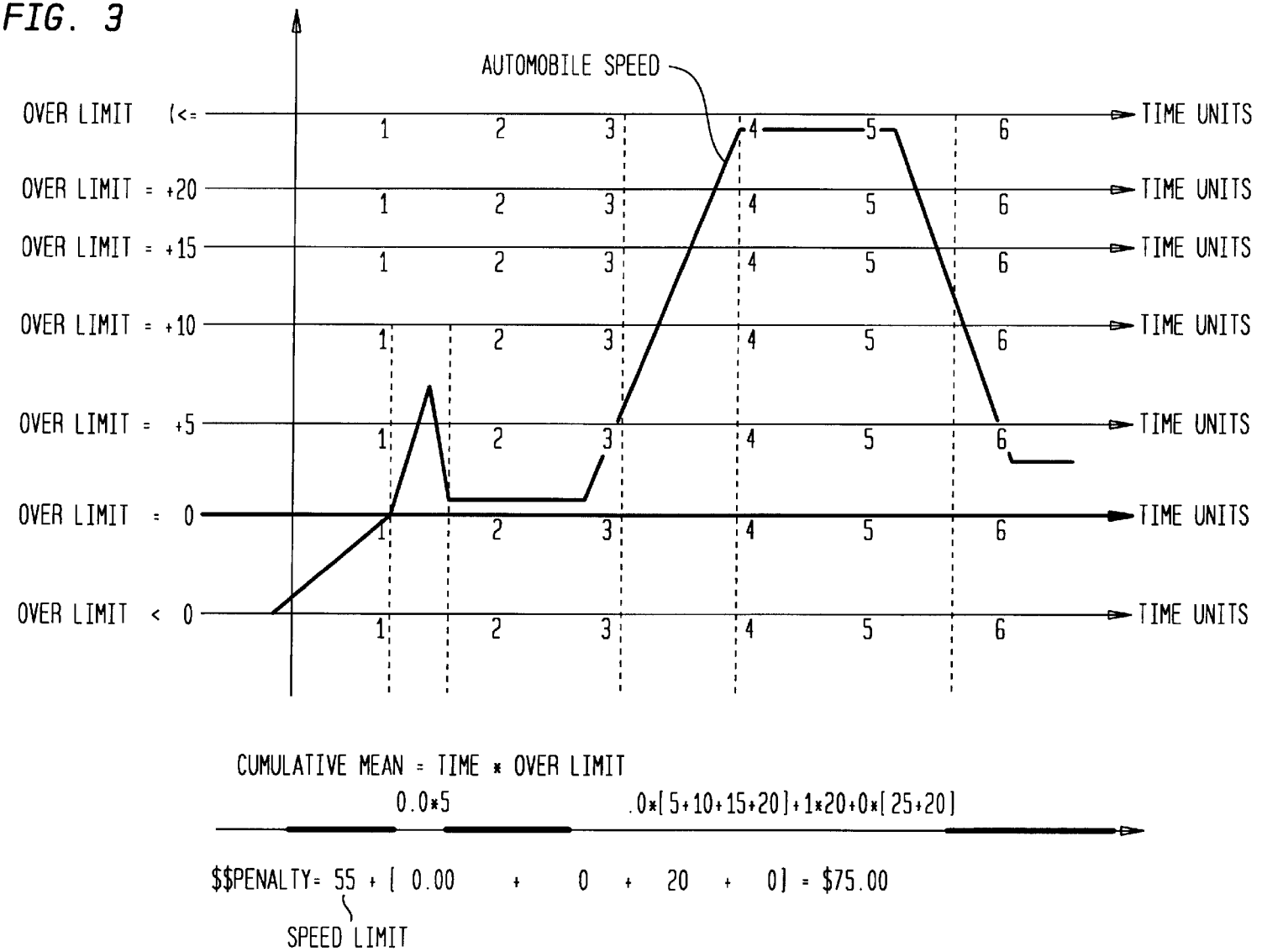
FIG. 3 is a chart depicting an example of a different response provided by the present invention.

As seen in the exemplary table of FIG. 3, processing unit 60 may analyze the driving pattern data and the speed limit data and determine whether a response is necessary, and if so, which response or combination of responses should be initiated based on numerous parameter permutations. As seen in FIG. 3, determining whether a response should be initiated, and what response should be initiated, can depend in part upon on elapsed time, speed of the vehicle and the speed limit of the highway. Thus, the system of the present invention preferably utilizes a weighting scheme or algorithm to determine the appropriate response. For example, depending on the driver's history and/or the speed in excess of the speed limit, the responses vary in degree such as merely giving audio or visual warnings to actually taking control of the vehicle.

The operation of a preferred embodiment of the present invention will now be described. In a preferred embodiment, in order to unlock the door to vehicle 12, driver 30 first must swipe their driver's license or other data-containing-type card or device through a reader (not shown) located on the vehicle 12. Processing unit 60 is updated with current driver information upon swiping the card. Processing unit 60 may also check to confirm whether driver 30 is an authorized driver of vehicle 12. When vehicle 12 is started, the system is initialized to begin recording the driving pattern of driver 30 for the current run. By way of a non-limiting example, a current run may be defined as the starting of vehicle 12, a drive of more than 10 miles, and the turning off of vehicle 12. Driver 30's driving pattern data may be stored for several days or several runs, as a matter of design choice. Vehicle 12's odometer reading is digitized and input into processing unit 60.

As seen in FIG. 1, as vehicle 12 is moving down the highway, signboard 36 transmits burst of speed limit data at regular intervals, or as an alternative, signboard 36 may be probed by approaching vehicle 12 to gather the speed limit data. Signboard 36 may also be turned on by approaching vehicle 12 by the vibrations, acoustic waves or direct or reflected electromagnetic or optical waves given off by approaching vehicle 12. In any event, by way of a non-limiting example, processing unit 60 receives speed limit data, which, in a preferred embodiment, comprises the speed limit for the current stretch of roadway, but may also comprise other information such as, National/State name code (i.e., what state are we in), the highway/road/street identification number, normal/construction/school zone, etc. Alternatively, the same type of data may be derived by processing unit 60 based on data supplied via a global positioning system (not shown), an onboard database (not shown), or vehicle 12 may gather the data from signpost 36 via an infrared sensor or other optical reading bar codes on signpost 36. In any event, as seen in FIG. 2, the speed limit data is gathered and communicated to processing unit 60. Processing unit 60 is also receiving driving pattern data from sensors 48. The driving pattern data preferably comprises at a minimum the speed the vehicle is traveling at, but may also comprise data indicative of how long that speed has been maintained as well as past speeds and the elapsed time associated with those speeds. That is, sensors 48 sense and/or gather data indicative of a driving pattern for a period of time. Sensors 48 may gather data regarding how long driver 30 has been driving at a certain speed, and what the corresponding speed limit was, or is, for that particular stretch of roadway. For example, over the past 11 minutes and 30 seconds, driver 30 may have driven 5 miles per hour over the speed limit for a period of 15 seconds, 15 miles per hour over the speed limit for 8 minutes, and 10 miles per hour under the speed limit for 3 minutes. Sensors 48 communicate this data to processing unit 60. Processing unit 60 analyzes the speed limit data and driving pattern data, determines whether a response is needed, and if so, initiates an appropriate predetermined action or response, as set forth below.

Which predetermined action is initiated, if any, will depend on a number of factors, for example, the speed of vehicle 12, the time at such speeds, the amount of time spent in each speed zone, and the amount such speeds are over posted speed limits. As seen in FIG. 3, the system of the present invention preferably determines the amount of drive time spent in each speed limit zone and the miles per hour over the speed limit. Cumulative penalty information may be displayed to warn driver 30 of the possible penalties. If a construction zone is detected, driver 30 may be notified of the same, and the amount of the penalty may be increased as per local law, or as an alternative, vehicle 12 may be automatically slowed down by processing unit 60 to the speed limit. The local speeding laws and speeding penalties may be stored in processing unit 60 or obtained from signboard 36.

When the speed of vehicle 12 is beyond a preset limit, for example 15 miles over the posted limit, an audio and/or visual display may be activated. Such displays may include information such as, the cost of the speeding ticket, amount of the insurance surcharge, the probability of an accident, and/or a display of family member pictures with a caption or audio message stating, "We all love you, please slow down". If vehicle 12 speeds beyond another preset limit, for example, 20 miles per hour over the limit for a certain time, i.e., 10 minutes, vehicle 12 may automatically notify the police. That is, processing unit 60 on vehicle 12 may communicate with processing unit 60 or antenna 32 on police vehicle 10. Once the communication is established, policeman 28 can access the processing unit 60 on vehicle 12 and obtain the previously stored and updated information about driver 30, the driving pattern data, and any other information stored on or otherwise accessible from processing unit 60. Policeman 28 may also be put in direct audio communication with driver 30. The range of communication can be any number of miles, as a matter of design choice. Because the two are in direct or indirect communication, policeman 28 may give driver 30 the option of stopping somewhere up ahead along the roadway to receive the speeding ticket, or may give driver 30 the option of having the speeding ticket sent directly to the driver's home, or automatically cause a speeding ticket to be sent. The driver's address would be among the information stored in processing unit 60. This would eliminate the dangerous condition of having vehicles stopped on the side of busy highways, and eliminate the "rubber necking" associated with such stops. One of skill in the art will recognize that in accordance with the instant invention, a single police officer could monitor any number of vehicles simultaneously. Furthermore, while many States allow the use of radar detectors, such radar detectors would be incapable of erasing the driving pattern data stored on processing unit 60. Thus, it would become much more difficult to elude police detection, and more habitual speeders could be caught.

As an alternative, the police may be able to automatically reduce the speed of vehicle 12 or entirely disable the car via remote activated vehicle control system (not shown). This will lead to less high speed vehicle chases. Due to this efficiency, the police may be able to offer drivers who accept such an option a discount on the full speeding ticket. For out of state drivers, the police may require the driver to pull over and pay the ticket immediately via a credit card. Revenue for the state would be realized immediately. As an alternative, vehicle 12 may establish communication directly with the insurance company. Like the police, the insurance company could access the processing unit 60 on vehicle 12 to retrieve the driving pattern data or any other data stored on, or otherwise accessible from, the processing unit 60. The insurance company could automatically penalize the driver. One of skill in the art will recognize that the amount and types of responses are limitless, and that the mere addition, subtraction, substitution or modification of the responses disclosed herein will not depart from the spirit of the present invention.

By way of an illustrative example, if the police are waiting on the side of the road to catch speeders, they may use the following protocol. The police may broadcast a burst requesting driving pattern data for a certain time, i.e., the past 5 minutes, from all the vehicles that receive the request. The cars would respond via a first detect first response (FDFR) basis with the car's Vehicle Identification Number (VIN) as a code. One of skill in the art will recognize that the overlap of the burst of driving pattern data from the car to the police can be resolved using several art-recognized approaches based on, for example, a random frequency offset, random delay in time to response or transmit and re-transmit after a random wait protocol. Once the communication is established, the police can select a few cars with certain VIN numbers to respond to. Once communication is established, the police can automatically obtain driver information, driving pattern data, car make, model, color, etc., or any other information stored on or otherwise accessible from processing unit 60, such as data specific to a driver's physical ability to control the vehicle, as set forth above. This will allow the police to selectively choose dangerous drivers. The entire system could be automated.

The system of the present invention will yield many advantages, including the effective enforcement of speed limits. For example, the speeder's insurance will go up and good driver's insurance could be lowered. When an accident does occur, the car's processing unit will have stored information regarding the driver's speed and steering column, etc. movements just before the accident. This is equivalent to the cockpit information stored "black boxes" on aircraft.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A system for enforcing roadway speed limits comprising:

an antenna and one or more sensors positioned on a vehicle;

said antenna capable of receiving data indicative of a speed limit for a roadway;

said one or more sensors capable of gathering driving pattern data comprising a current speed of said vehicle and an elapsed time said vehicle has been traveling at said current speed; and a processing unit in communication with said antenna and said one or more sensors, said processing unit receiving said speed limit data from said antenna and said driving pattern data from said sensors, analyzing said speed limit data and said driving pattern data to asses whether a predetermined action should be initiated, and initiating a predetermined action in response to said assessment;

wherein said antenna is also capable of receiving data from outside said vehicle for initiating a predetermined action, wherein said predetermined action is selected from a group of actions consisting of: reducing the speed of said vehicle, turning on a flasher signal of said vehicle, generating a speeding ticket, taking control of said vehicle, and disabling said vehicle.

2. The system according to claim 1, further comprising a second system, said second system comprising:

a second antenna positioned on said second system;

said second antenna capable of receiving data from said first vehicle antenna;

said second antenna capable of transmitting data to said first vehicle antenna to initiate a predetermined action in said first vehicle.

3. The system according to claim 2, wherein said second system is positioned on a second vehicle.

4. The system according to claim 1, wherein said antenna receives said speed limit data from a source along said roadway.

5. The system according to claim 3, wherein said roadway source comprising a signboard.

6. The system according to claim 1, wherein said antenna receives said speed limit data via a satellite system.

7. The system according to claim 1, wherein each one of said one or more sensors are selected from a group of sensors consisting of: motion sensors, infrared sensors, position sensors, audio sensors, video sensors, chemical sensors, sound sensors, touch sensors and radio frequency sensors.

8. The system according to claim 1, wherein said sensors also gather data indicative of conditions within said vehicle.

9. The system according to claim 1, wherein said sensors also gather data indicative of conditions outside said vehicle.

10. The system according to claim 1, wherein one or more of said sensors are positioned within a passenger cabin of said vehicle.

11. The system according to claim 1, wherein said processing unit comprises a Digital Signal Processor.

12. The system according to claim 11, wherein Digital Signal Processor utilizes parallel processing to carry out its processing.

13. The system according to claim 11, wherein Digital Signal Processor utilizes neural network/fuzzy logic to carry out its processing.

14. The system according to claim 1, wherein said processing unit is capable of communicating with devices other than said one or more sensors.

15. The system according to claim 1, wherein said predetermined action can be overridden by a source external to said system.

16. The system according to claim 1, wherein said one or more sensors are motion sensors, infrared sensors, position sensors, audio sensors, video sensors, chemical sensors, sound sensors, touch sensors or radio frequency sensors, or any combination thereof.

17. The system according to claim 1, wherein said predetermined action is selected from a group of actions consisting of: nothing, an audio signal, a visual signal, reducing the speed of said vehicle, turning on a flasher signal, automatically notifying the police or another party, taking control of said vehicle, and disabling said vehicle, or any combination thereof.

18. A method of enforcing speed limits on a roadway comprising the steps of:

a) gathering speed limit data indicative of a speed limit for a roadway;

b) gathering driving pattern data comprising a current speed of a vehicle and an elapsed time said vehicle has been traveling at said current speed;

c) analyzing said speed limit data and said driving pattern data to determine an appropriate response; and d) initiating said appropriate response, wherein said appropriate response is selected from a group of responses consisting of: reducing the speed of said vehicle, turning on a flasher signal of said vehicle, generating a speeding ticket, taking control of said vehicle, and disabling said vehicle.

19. The method according to claim 18 wherein step (d) is performed from a source other than said vehicle.

20. A system for enforcing roadway speed limits comprising:

an antenna and one or more sensors positioned on a vehicle;

said antenna capable of receiving data from which a speed limit for a roadway can be derived;

said one or more sensors capable of gathering driving pattern data comprising a current speed of said vehicle and an elapsed time said vehicle has been traveling at said current speed; and a processing unit in communication with said antenna and said one or more sensors, said processing unit receiving said speed limit data from said antenna and said driving pattern data from said sensors, analyzing said speed limit data and said driving pattern data to asses whether a predetermined action should be initiated, and initiating a predetermined action in response to said assessment, wherein said predetermined action consists of: reducing the speed of said vehicle, turning on a flasher signal of said vehicle, generating a speeding ticket, taking control of said vehicle, and disabling said vehicle.

* * * * *